US005743240A

United States Patent [19]

Zerrer et al.

[11] Patent Number: 5,743,240

[45] Date of Patent: Apr. 28, 1998

[54] HAND-GUIDED, PORTABLE TOOL WITH INTERNAL COMBUSTION ENGINE

[75] Inventors: Gerhard Zerrer; Manfred Reinhardt, both of Korb, Germany

[73] Assignee: Andreas Stihl, Waiblingen, Germany

[21] Appl. No.: 796,321

[22] Filed: Feb. 7, 1997

[30] Foreign Application Priority Data

Feb. 7, 1996 [DE] Germany ..... 196 04 288.7

[51] Int. Cl.[6] ..... F02M 17/04

[52] U.S. Cl. ..... 123/518; 261/35; 261/DIG. 68; 261/72.1

[58] Field of Search ..... 261/35, DIG. 68, 261/72.1; 123/518

[56] References Cited

U.S. PATENT DOCUMENTS

| | | | |
|---|---|---|---|
| 3,174,732 | 3/1965 | Brown | 261/DIG. 68 |
| 3,610,220 | 10/1971 | Yamada et al. | 123/518 |
| 3,610,221 | 10/1971 | Stoltman | 123/518 |
| 5,056,493 | 10/1991 | Holzer | 123/518 |
| 5,073,307 | 12/1991 | Langer et al. . | |
| 5,215,132 | 6/1993 | Kobayashi | 123/518 |
| 5,429,776 | 7/1995 | Edlund | 261/DIG. 68 |
| 5,526,843 | 6/1996 | Wolf et al. . | |

FOREIGN PATENT DOCUMENTS

| | | |
|---|---|---|
| 3346103 | 7/1985 | Germany . |
| 4419084 | 12/1994 | Germany . |

*Primary Examiner*—Tim R. Miles

*Attorney, Agent, or Firm*—Robert W. Becker & Associates

[57] ABSTRACT

A hand-guided, portable tool includes a housing and an internal combustion engine mounted in the housing. A fuel tank is mounted in the housing. The internal combustion engine has a carburetor with induction port for preparing a fuel/air mixture. An air filter is mounted in the housing. The air filter has a clean air side that is connected to the induction port. The internal combustion engine also has a control chamber with inlet valve. The control chamber is filled with fuel supplied thereto via the inlet valve from the fuel tank. The control chamber supplies fuel to the carburetor. The internal combustion engine has a compensation chamber delimited on one side by a control diaphragm that controls the inlet valve. The compensation line connects the compensation chamber to the clean air side of the air filter. The compensation line has a first connection section connected to the clean air side of the air filter and a second connection section connected to the compensation chamber. A pressure-equalization line for connecting the fuel tank to the clean air side of the air filter is provided, wherein the pressure-equalization line opens into the compensation line at a location between the first and second connection sections.

14 Claims, 4 Drawing Sheets

HAND-GUIDED, PORTABLE TOOL WITH INTERNAL COMBUSTION ENGINE

BACKGROUND OF THE INVENTION

The invention relates to a hand-guided, portable tool, especially abrasive cutting tools, power chain saws or the like, having a housing enclosing an internal combustion engine, to which is supplied a fuel/air mixture via a carburetor. The carburetor is connected with one side to the clean air side of the air filter. With another side it sucks in fuel from a fuel-filled control chamber. Fuel is supplied via an inlet valve from a fuel tank to the control chamber. The inlet valve is controlled by a control diaphragm delimiting a compensation chamber connected via a compensation channel to the clean air side of the air filter.

German Offenlegungsschrift 44 19 084 discloses a tool of the aforementioned kind, namely a power chain saw, which is driven by an internal combustion engine. The air required for combustion is sucked in from the atmosphere through an induction port by way of an induction air filter, whereas the fuel to be mixed therewith is supplied from a fuel tank by way of a carburetor located in the induction port. For conveying the fuel into the control chamber of the diaphragm carburetor, a pneumatic fuel pump is provided in the carburetor casing, which pump is driven by way of a pulse line by the crankcase pressure. The control diaphragm, on the one hand, controls an inlet valve opening into the control chamber and, on the other hand, defines a compensation chamber positioned on the dry side of the control diaphragm. The compensation chamber is connected by way of a compensation line to the clean air side of the induction air filter. With increasing contamination of the air filter, the vacuum increase on tire clean air side will also develop in the compensation chamber, so that the opening action of the inlet valve is adapted to the increasing vacuum in the induction port. Correspondingly, less fuel is supplied to the combustion air stream that is reduced by the contamination of the air filter, so that the composition of the mixture remains essentially the same.

German Offenlegungsschrift 44 19 084describes a complicated construction for a direct connection of the compensation chamber to the clean air side of the induction air filter without connecting lines. However, this design greatly reduces the flexibility in regard to the location of the components including the air filter, induction port, and carburetor. For example, it is necessary that one housing wall of the air filter box defining the clean air side of the air filter is placed closely adjacent to the outer wall of the compensation chamber. Further connection possibilities for the compensation chamber are disclosed in German Offenlegungsschrift 39 03 192.

The internal combustion engines operated in hand-guided tools are supplied with fuel from a fuel tank which is located in the casing of the tool. For the equalization of pressure, the fuel tank comprises a venting valve for supplying and removing air so that the vacuum caused by the removal of fuel can be compensated and excess pressure occurring due to ambient temperature increase can be reduced. Such a venting valve for supplying and removing air is known from German Offenlegungsschrift 43 29 876 and is generally connected to the atmosphere. Systems of this type are therefore also referred to as "open systems".

It is the object of the invention to develop a tool of the aforementioned kind with which a closed system for supplying and removing air to or from the fuel tank is possible allowing great design flexibility in regard to the location of the air filter and carburetor.

SUMMARY OF THE INVENTION

The hand-guided, portable tool according to the present invention is primarily characterized by:

a housing;

an internal combustion engine mounted in the housing;

a fuel tank mounted in the housing;

the internal combustion engine comprising a carburetor for preparing a fuel/air mixture;

the carburetor having an induction port;

an air filter mounted in the housing, the air filter having a clean air side;

the clean air side connected to the induction port of the carburetor;

the internal combustion engine further comprising a control chamber having an inlet valve;

the control chamber filled with fuel supplied thereto via the inlet valve from the fuel tank;

the carburetor connected to the control chamber for supplying fuel to the carburetor;

the internal combustion engine further comprising a compensation chamber delimited on one side thereof by a control diaphragm;

the control diaphragm controlling the inlet valve;

a compensation line connecting the compensation chamber to the clean air side of the air filter;

the compensation line comprising a first connection section connected to the clean air side of the air filter and a second connection section connected to the compensation chamber;

a pressure-equalization line for connecting the fuel tank to the clean air side of the air filter, wherein the pressure-equalization line opens into the compensation line at a location between the first and second connection sections.

The first and second connection sections have different lengths.

The first connection section is preferably shorter than the second connection section.

The tool further comprises a T-connector. The compensation line and the pressure-equalization line are hoses, and the T-connector connects the pressure-equalization line to the first and second connection sections.

The hoses of the compensation line and of the pressure-equalization line have an identical diameter.

An inlet of the pressure-equalization line into the compensation line is located close to the air filter.

The air filter comprises an air filter box and the compensation line opens into the air filter box.

The compensation line opens into the induction port at a location between the air filter and a throttle valve of the carburetor.

The pressure-equalization line comprises a venting valve for supplying and removing air to and from the fuel tank.

The carburetor comprises a housing and the compensation line is preferably integrated into the housing.

The carburetor comprises a housing and the compensation line is integrated into the housing and into the induction port.

The compensation line may be integrated into the induction port.

The tool further comprises an equalizing reservoir connected to the fuel tank. The pressure-equalization line is connected to the equalizing reservoir.

A connecting line is provided for connecting the fuel tank to the equalizing reservoir, wherein the connecting line comprises a throttle.

The connection of the pressure-equalization line to the compensation line creates a closed system, due to which, with proper use of the tool, the escape of fuel into the atmosphere is largely prevented. If excess pressure builds up in the fuel tank, the vapors enriched with vaporized fuel are guided via the pressure-equalization line and the compensation line indirectly or directly to the clean air side of the induction air filter and from there, at the time of operation of the internal combustion engine, are sucked out by way of the carburetor into the internal combustion engine. Even if liquid fuel passes into the compensation line, on entering the induction port of the air filter box, the fuel is discharged by incoming combustion air to the internal combustion engine. Since the pressure-equalization line can be connected to any point of the compensation line, great design flexibility is achieved with connection sections which nevertheless can be kept short. If vacuum builds up in the fuel tank, clean compensating air flows in by way of the pressure-equalization line from the clean air side of the air filter.

Due to the structural design of the connection sections of the compensation line, determined by the length of the connection sections, the attachment of these sections to the pressure-equalization line is only possible in a given region of the housing. Accordingly, assembly errors can be avoided. The connection of the pressure-equalization line is preferably between two connection sections of the compensation line, the opening of the pressure-equalization line being positioned as close as possible to the air filter.

The prevention of assembly errors, possible due to the structural measures, ensures on the other hand a construction of the compensation line and of the pressure-equalization line as hoses, which can be connected to each other by way of a T-connector. The hoses in this case may be of identical design and especially may have the same diameter, so that the storing expenditure is low. It is only necessary to store one hose type of one color, one choice of material, and one diameter.

BRIEF DESCRIPTION OF THE DRAWINGS

Further features of the invention will become apparent from the claims, description and drawings, in which embodiments of the invention described in detail hereafter are illustrated. In the drawings:

DESCRIPTION OF PREFERRED EMBODIMENTS

Figure 1:
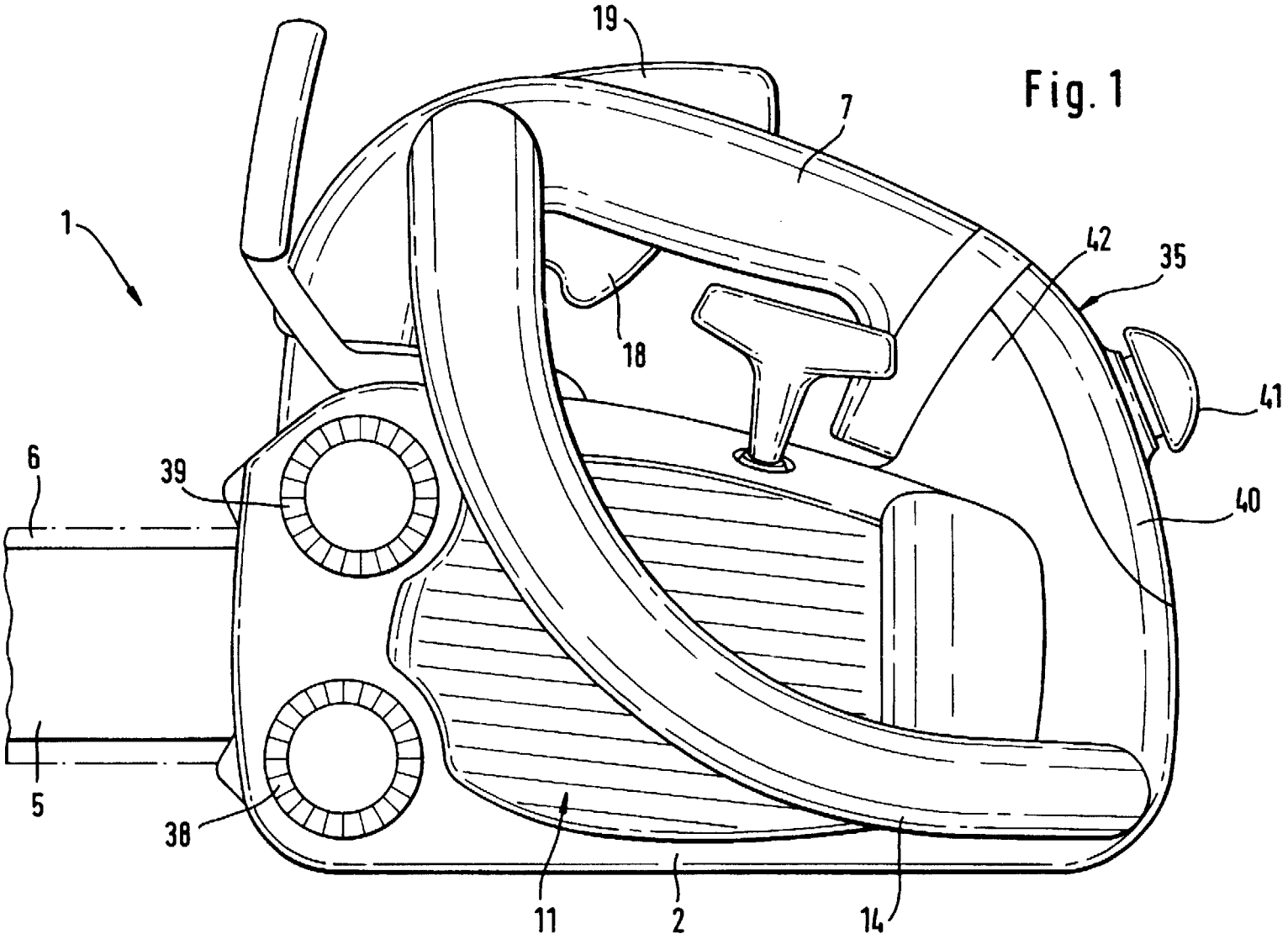
FIG. 1 is a view of a hand-guided tool in the form of a power chain saw.

The power chain saw 1 illustrated in FIG. 1 as an example of a hand-guided, portable tool, consists essentially of a housing 2 receiving the internal combustion engine 11 with its attached parts, which comprises an upper handle 7 aligned in the longitudinal direction of the power chain saw and a side handle 14 extending from the upper handle at a distance to the side of the housing to the lower rear end of the housing. Located in the upper handle is a throttle lever 18 as well as a throttle lever lock 19. The internal combustion engine drives a saw chain 6 revolving on a guide bar 5, which extends in the longitudinal direction of the power chain saw from the front end of the housing 2 forwardly.

The upper handle 7 is supported at its rear end on a housing projection, which comprises a carburetor 35 and an air filter. The air filter housing or box is closed by an air filter cover 40. After releasing the locking knob 41, the air filter cover 40 can be removed and the induction air filter 37 can be changed (FIG. 2).

Provided in the region of the front end of the housing 2 are filling openings 38 and 39 for a fuel tank and an oil tank.

Figure 2:
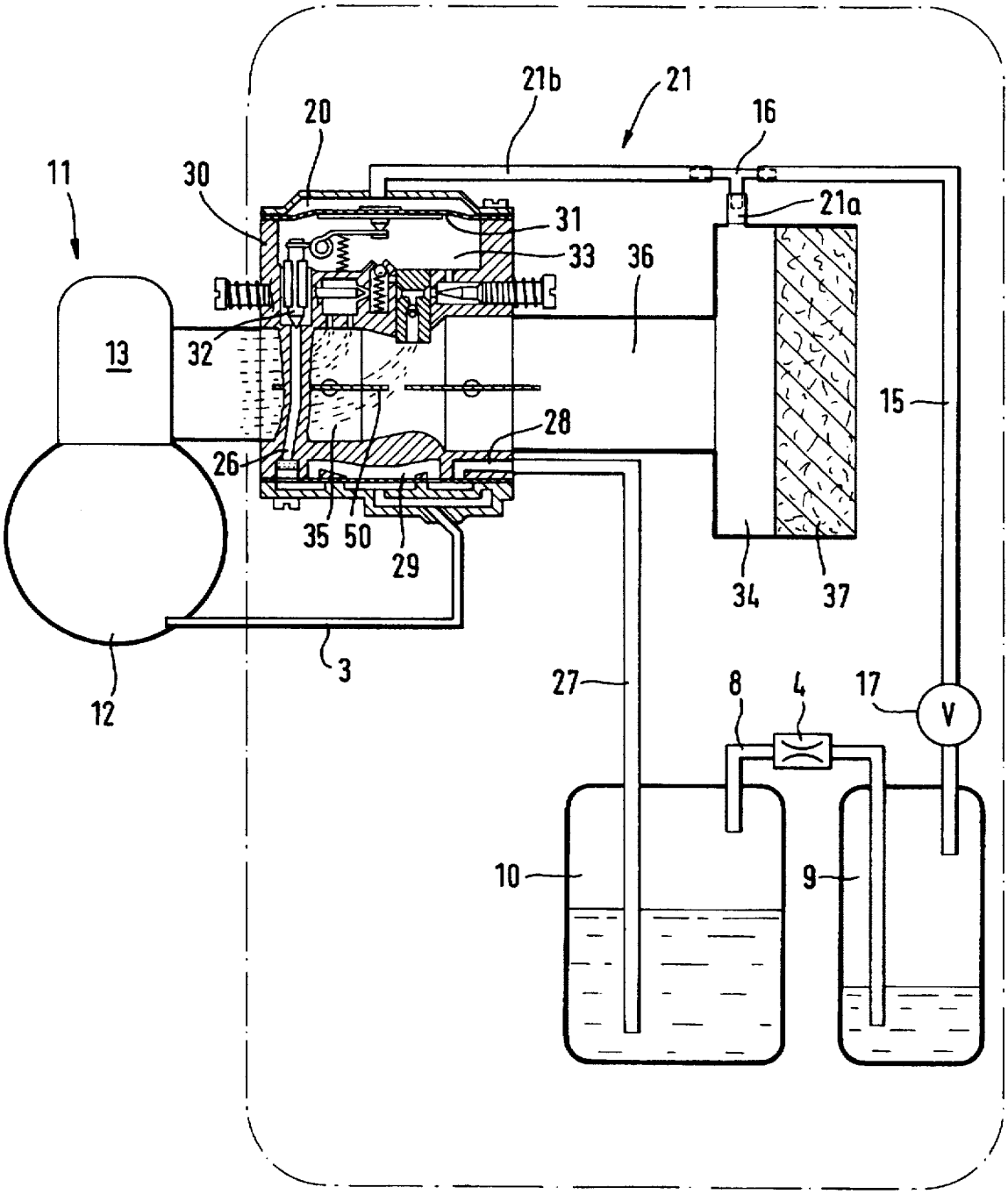
FIG. 2 is a schematic illustration of a closed system for removing air from a fuel tank.

The essential parts located in the housing 2 of the tool according to FIG. 1 are shown schematically in FIG. 2. The internal combustion engine 11 consists essentially of a crankcase 12 with a cylinder 13, to which a mixture of fuel and air for operating the internal combustion engine 11 is supplied by way of an induction port 36. The fuel/air mixture is formed in a carburetor 35, which at one side sucks in combustion air by way of an induction air filter 37 and mixes it with fuel entering the induction port 36 by way of nozzles from a control chamber 33. The fuel is supplied from a fuel tank 10 by way of an inlet valve 32 to the control chamber 33.

For conveying the fuel, a fuel pump 29 is integrated in the carburetor housing 30. The pump is driven pneumatically via a pulse line 3 by the pressure fluctuations in the crankcase 12. The suction connection 28 of the fuel pump 29 is connected by a fuel line 27 to the fuel tank 10. The pressure connection 26 of the fuel pump is sealed by the inlet valve 32. The inlet valve 32 is controlled by a control diaphragm 31, which defines the control chamber 33.

On its dry side, the control diaphragm 31 delimits a compensation chamber 20, which is connected by way of a compensation line 21 to the induction port 36 between the carburetor 35 and air filter 37, i.e., to the clean air side 34 of the induction air filter 37. Thus, the vacuum increasing on the clean air side 34 with increasing contamination of the air filter 37, simultaneously is present in the compensation chamber 20 so that the vacuum necessary for opening the inlet valve 32 in the control chamber 33 is increased. In this way, the quantity of air decreasing with increasing contamination of the air filter can be compensated for by a correspondingly reduced addition of fuel; the fuel/air mixture remains largely unchanged. This effect can also be achieved when the compensation line 21 branches off from the venturi section upstream of the throttle valve 50.

The fuel tank 10 is connected by way of a connecting line 8 to an equalizing reservoir 9, a throttle 4 being located in the connecting line 8. If the pressure in the fuel tank 10 increases as a result of a temperature increase, a pressure reduction occurs by way of the connecting line 8 in the equalizing reservoir 9. Fuel may also pass into the equalizing reservoir 9. If a vacuum occurs on account of the removal of fuel from the fuel tank 10 via the fuel line 27, it is equalized by supplying air from the equalizing reservoir 9. Fuel possibly present in the equalizing reservoir is returned via the connecting line 8 to the fuel tank 10 at the time of supplying air to the fuel tank 10.

For supplying air and removing air from the equalizing reservoir 9, a pressure-equalization line 15 is provided, in which a venting valve 17 for supplying and removing air is located. The venting valve 17 for supplying and removing air is provided close to the equalizing reservoir 9 and may consist essentially of two parallel non-return valves opening in opposite directions. The pressure-equalization line 15 opens into the compensation line 21. In the; embodiment according to FIG. 2, both the compensation line 21 as well as the pressure-equalization line 15 consist of hoses. Thus, the pressure-equalization hose 15 is connected by way of a T-connector 16 to the compensation hose 21. Since the T-connector 16 can be connected in any orientation to the hoses, incorrect assembly is largely precluded. The pressure-equalization line 15 may also be directly connected to the fuel tank 10, so that an equalizing reservoir 9 is obsolete.

As shown in FIG. 2, the compensation line 21 in the form of a hose is connected to the clean air side 34 of the air filter 37 via a first connection section 21*a*, whereas a second connection section 21*b* connected to the compensation chamber 20. In this case, the connection sections 21*a* and 21*b* have different lengths. The first section 21*a* is preferably shorter than the second section 21*b*. Thus, the T-connector needs to be inserted in the compensation line 21 solely in the vicinity of the air filter 37. The length of the pressure-equalization hose 15 as well of the connection section sections 21*a* and 21*b* may be chosen so that a connection of the hose ends is possible only at the location of the T-connector 16. On account of the selected hose lengths, confusion with other hoses to be mounted on the carburetor housing 30, such as, for example, the pulse line 3 from the crankcase 12 or the fuel line 27 from the fuel tank 10 can be reliably avoided. Despite the necessary connection of many hoses and lines, due to the structural design of the hose lengths and their structurally pre-selected connection points, the risk of confusion is largely minimized.

This also has the advantage that all hoses may be the same color and, in particular, may have the same diameter. Thus, only a certain type of hose must be kept in stock for manufacturing, and this reduces the material costs and thus the manufacturing costs.

Figure 4:
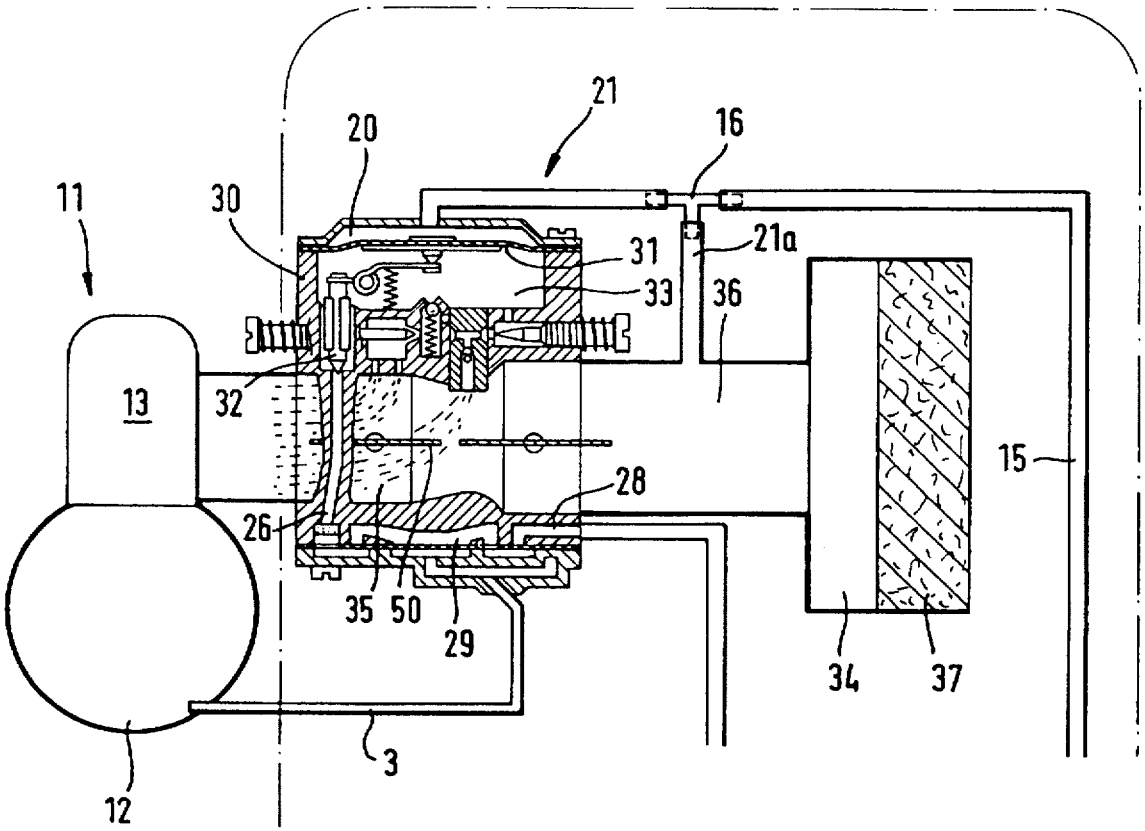
FIG. 4 shows another embodiment of a closed system with the compensation line opening into the induction port.

Gases escaping from the fuel tank 10 flow via the equalizing reservoir 9 and the pressure-equalization line 15 into the compensation line 21 and its connection section 21*a* and to the clean air side 34 of the air filter 37 to be conveyed via the induction port 36 to the internal combustion engine 11. The connection section 21*a* may also be connected to the induction port 36 between the carburetor 35 and air filter 37 (see FIG. 4). A compensation line 21 provided in the carburetor housing 30 may be appropriate, which opens upstream of the throttle valve 50 into or upstream of the venturi section. For reducing the vacuum, clean air flows from the clean air side 34 via the connection section 21*a*, the pressure-equalization line 15, and the equalizing reservoir 9 into the fuel tank 10.

Figure 3:
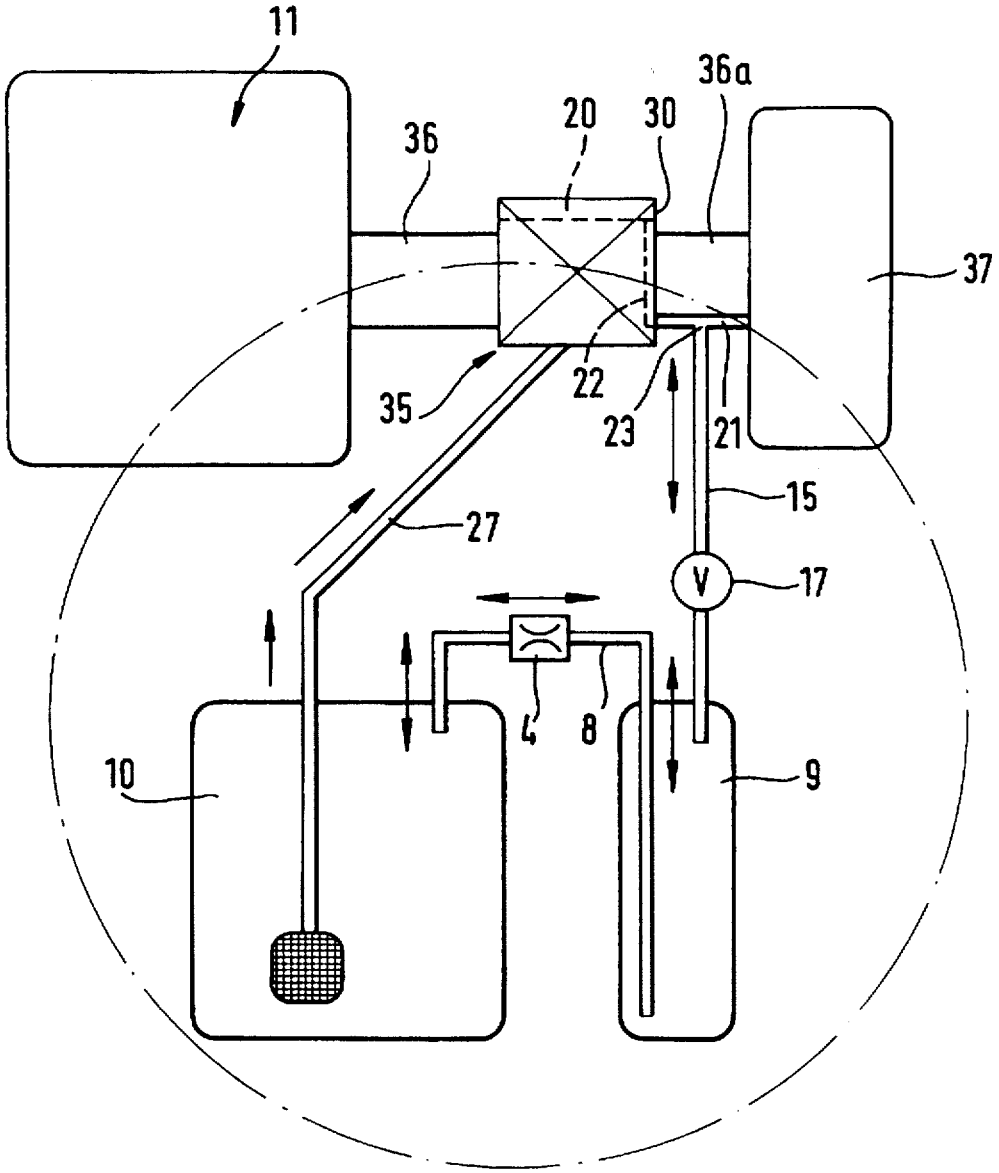
FIG. 3 is a schematic illustration of another embodiment of a closed system for removing air from a fuel tank.

In the embodiment according to FIG. 3, the schematically illustrated internal combustion engine 11 is connected by way of an induction port 36 and a likewise schematically illustrated carburetor 35 to an induction air filter 37. The conveyance of fuel from the fuel tank 10 by way of the fuel line 27 takes place in the same way as illustrated in FIG. 2. The fuel tank 10 is connected by way of a connecting line 8 and a throttle 4 to an equalizing reservoir 9, which is, in turn, supplied with air and from which air is removed via the pressure-equalization line 15. A venting valve 17 for supplying and removing air is provided in the pressure-equalization line 15.

The pressure-equalization line 15 can appropriately open directly into the induction port 36, preferably into the induction port section 36*a* between the air filter 37 and the carburetor 35. As shown schematically in FIG. 3, a compensation line 21 is integrated in the induction port section 36*a*. This line 21 is connected by way of a line section 22, integrated in the carburetor housing 30, to the compensation chamber 20. As shown in FIG. 3, the pressure-equalization line 15 opens into the compensation line 21 integrated in the induction port section 36*a*, the inlet 23 being located close to the air filter. A closed system for supplying and removing air is thus realized. Neither gases containing fuel nor liquid fuel may escape to the outside if the tool is correctly operated. This is essential especially in the case of abrasive cutting tools, since these tools exhibit a great tendency to release sparks during operation, due to which the risk of fire may be increased.

The present invention is, of course, in no way restricted to the specific disclosure of the specification and drawings, but also encompasses any modifications within the scope of the appended claims.

What we claim is:

1. A hand-guided, portable tool comprising:

a housing;

an internal combustion engine mounted in said housing;

a fuel tank mounted in said housing;

said internal combustion engine comprising a carburetor for preparing a fuel/air mixture;

said carburetor having an induction port;

an air filter mounted in said housing, said air filter having a clean air side;

said clean air side connected to said induction port of said carburetor;

said internal combustion engine further comprising a control chamber having an inlet valve;

said control chamber filled with fuel supplied thereto via said inlet valve from said fuel tank;

said carburetor connected to said control chamber for supplying fuel to said carburetor;

said internal combustion engine further comprising a compensation chamber delimited on one side thereof by a control diaphragm;

said control diaphragm controlling said inlet valve;

a compensation line connecting said compensation chamber to said clean air side of said air filter;

said compensation line comprising a first connection section connected to said clean air side of said air filter and a second connection section connected to said compensation chamber;

a pressure-equalization line for connecting said fuel tank to said clean air side of said air filter, wherein said pressure-equalization line opens into said compensation line at a location between said first and second connection sections.

2. A tool according to claim 1, wherein said first and second connection sections have different lengths.

3. A tool according to claim 1, wherein said first connection section is shorter than said second connection section.

4. A tool according to claim 1, further comprising a T-connector, wherein said compensation line and said pressure-equalization line are hoses and wherein said T-connector connects said pressure-equalization line to said first and second connection sections.

5. A tool according to claim 4, wherein said hoses of said compensation line and of said pressure-equalization line have an identical diameter.

6. A tool according to claim 1, wherein an inlet of said pressure-equalization line into said compensation line is located close to said air filter.

7. A tool according to claim 1, wherein said air filter comprises an air filter box and wherein said compensation line opens into said air filter box.

8. A tool according to claim 1, wherein said compensation line opens into said induction port at a location between said air filter and a throttle valve of said carburetor.

9. A tool according to claim 1, wherein said pressure-equalization line comprises a venting valve for supplying and removing air to and from said fuel tank.

10. A tool according to claim 1, wherein said carburetor comprises a housing and wherein said compensation line is integrated into said housing.

11. A tool according to claim 1, wherein said carburetor comprises a housing and wherein said compensation line is integrated into said housing and into said induction port.

12. A tool according to claim 1, wherein said compensation line is integrated into said induction port.

13. A tool according to claim 1, further comprising an equalizing reservoir connected to said fuel tank, said pressure-equalization line connected to said equalizing reservoir.

14. A tool according to claim 13, comprising a connecting line for connecting said fuel tank to said equalizing reservoir, wherein said connecting line comprises a throttle.

* * * * *